United States Patent [19]

Glock

[11] Patent Number: 4,510,645

[45] Date of Patent: Apr. 16, 1985

[54] CONSTRUCTION OF DRAW FRAMES FOR SPINNING MACHINES

[75] Inventors: Alfred Glock, Stuttgart, Fed. Rep. of Germany

[73] Assignee: SKF Kugellagerfabriken GmbH, Schweinfurt, Fed. Rep. of Germany

[21] Appl. No.: 512,909

[22] Filed: Jul. 11, 1983

[30] Foreign Application Priority Data

Jul. 13, 1982 [DE] Fed. Rep. of Germany ..... 3226151

[51] Int. Cl.[3] ..... D01H 13/16

[52] U.S. Cl. ..... 19/0.25; 19/236; 19/239; 57/81; 57/83; 57/265

[58] Field of Search ..... 19/0.25, 236, 239; 57/81, 87, 83, 265

[56] References Cited

U.S. PATENT DOCUMENTS 3,726,072 4/1973 Ford et al. ..... 57/83 X
3,841,076 10/1974 Ford et al. ..... 57/83
4,428,097 1/1984 Adamson ..... 19/0.25
4,432,195 2/1984 Stahlecker ..... 19/0.25 X
4,450,677 5/1984 Ronai-Horvath ..... 19/0.25 X

*Primary Examiner*—Louis K. Rimrodt
*Attorney, Agent, or Firm*—Murray Schaffer

[57] ABSTRACT

A draw frame for spinning machine is provided with a blocking mechanism movable into a position between the upper and lower feed rollers in the event of yarn breakage, to lift the roving from contact with the driven rollers. The blocking member is mounted on a rail, extending parallel to a load arm on which the upper rollers are mounted. Both load arm and the bearing arm rail are swivelably mounted. Each of the bearing rails are arranged so that they are weighted by the supporting arm, when placed in the operating position, by a resilient member acting on a connecting member between the bearing rails.

7 Claims, 2 Drawing Figures

CONSTRUCTION OF DRAW FRAMES FOR SPINNING MACHINES

BACKGROUND OF THE INVENTION

The present invention relates to the construction of draw frames for thread-spinning machines and in particular to apparatus for facilitating the mounting of the roller support arm and bearing rail for the associated roving blocking mechanisms.

The conventional spinning machine is provided with a draw frame having at least a set of inlet rollers for receiving the roving from a source at least one intermediate set of rollers, and a set of exit rollers spaced therefrom between which the roving is drawn. The exit rollers feed the drawn material as threaded yarn onto a bobbin or cop on which it is wound. The sets of rollers each comprise a driven lower roller and a pair of axially spaced twin upper rollers permitting the drawing of two rovings side by side. The upper rollers are journalled in rank pairs on a common supporting load arm extending in the direction of drawing. Such machine is disclosed in the DE-OS No. 2,257,323 corresponding to Ford, U.S. Pat. No. 3,726,072 dated Apr. 3, 1973 which also provides means for sensing the proper winding of the drawn thread.

In the commonly owned copending application Ser. No. 335,210 filed Dec. 28, 1981, 4,484,376, 27 Nov. 1984, we have drsclosed several safety features, one of which comprises a device for blocking the roving at the upstream rollers when the thread or yarn breaks or ruptures at the downstream end. A holding device is also disclosed in association with the blocking device located between the upstream and the downstream rollers. This holding device provides a laterally cantilevered table which grasps the forward most end of the roving, and/or partially finished thread, so as to facilitate the manual loading of the roving preparatory to initially starting or restarting the draw frame. That is, when the operation of the drawing frame is to be initiated either initially or after a clearance of a break in a thread, the roving must be placed into the drawing frame between the upper and lower rollers. In this instance, the upper rollers are raised to permit the roving to be manually inserted between the rollers from the open side. Under normal conditions this requires special attention and manual operation on the part of the machine operator. The holder disclosed on our earlier application merely allows the forward end of the roving to be accessible for handling.

The blocking member and its switching mechanism are arranged on a bearing rail running parallel to the roving. Two bearing rails are provided for each draw frame, one on each side of the support arm holding the twin upper rollers. The bearing rails are swivelable about an axis and is provided with spring means and a stop device. The spring means holds the bearing rail in its operation position, which is horizontal and parallel to the load arm and which is determined by a stop member. The bearing rail is swivelable opposite to the spring force into a non operating position also determined by an upper stop device. A coupling yoke is mounted on the support arm. The yoke reaches over the bearing rail by means of an arm which is offset laterally at an angle and which is provided with a claw embracing the bearing rail. The claw has a degree of clearance with respect to the bearing rail which in the operating position is provided for the purpose for preventing undue force from acting on the support arm. The clearance is also important when the swivel axes of the bearing rails do not run coaxially but are offset laterally in relation to the swivel axis of the support arm. The displacement of the two bearing rails, occurring during the swiveling motion of the support arm, may then take place unhindered since the bearing rails are capable of sliding within the coupling claws of the yoke.

On the whole, this swivel bearing with its devices for determining the two swivel positions of the bearing rails and also the coupling devices with the support arm are relatively expensive. There are also difficulties in manipulating the support arm and bearing rails when the roving to be drawn is to placed on the lower rollers, with the swiveled support arm in its non operating upward position because of the coupling yoke projecting into the path of insertion.

It is the objective of the present invention to simplify the construction of the draw frame and to avoid the disadvantages and difficulties found in the prior art.

It is an object of the present invention to simplify the mounting of the bearing rail so that they pivot and are retained in both the upper and non operating position and lowered operating position in a safe operating condition.

Further advantages and objects of the present invention are set forth in the following disclosure.

SUMMARY OF THE INVENTION

According the present invention, a draw frame for spinning machine is provided with a blocking mechanism movable into a position between the upper and lower feed rollers in the event of yarn breakage, to lift the roving from contact with the driven rollers. The blocking mechanism holds the roving between itself and the upper rollers so as to block its further movement. The blocking member is mounted on a rail, extending parallel to the load arm on which the upper rollers are mounted. Both load arm and the bearing arm rail are swivelably mounted. Each of the bearing rails are arranged so that they are weighted by the supporting arm, when placed in the operating position, by a spring loaded resilent plunger member acting on a connecting member between the bearing rails.

In accordance with the present invention the bearing rails are held only by a simple swivel bearing since they are biased in operating position by way of the spring loaded plunger and the supporting arm which bears against it.

The connecting member joining the two bearing rails with each other is located at a point along the draw frame where it does not interfere with the insertion of a roving into the draw frame, which could then be carried out in the usual manner. In general, this position lies just ahead of the usual bridge and belt of the drawing frame.

Preferably, the plunger is spring loaded and balances the tolerances between the support arm and the bearing rail in the operating position so that the support arm weighs against the bearing rail with a predetermined minimum force. Instead of using a special compression spring, the plunger and/or the connecting member can be manufactured of elastic material such as sponge rubber and the like. In the simpliest embodiment the support is mounted on the connecting member joining the two bearing rails and is provided with a plane surface on which the plunger comes to rest with the flat or rounded face.

The present invention is adaptable to a support arm which is liftable to afford a partial relief on the load of the rollers. Even when the support arm is in this intermediate position, the bearing rails may be held safely in the operating position by the still effective spring force of the plunger. Through this partial relief, the clamping sites betwen the upper and lower rollers are relieved from undue pressure and force during the period when the machine stands still for a longer period then necessary to correct a roving failure or to reload the drawing frame.

Preferably, the plunger comprises a pair of telescoping tubes in which a compression spring is mounted; the tubes being arranged so that their relative outward movement is limited. In this arrangement, the compression spring is enclosed in the telescoping tubes and is protected against debris or fly-fibres.

A further advantage of the present invention arises by providing a snap coupling between the plunger mechanism and the connecting member joining the bearing rails. In this construction, the bearing rails can be swiveled simulataneously with the supporting arms or alternately can be maintained in operating position while the supporting arm is moved.

The connecting member joining the two bearing rails with each other may be in any desired shape although preferably a simple rod or the like is preferred. Preferably, the connecting member should be removable so that it either may be replaced or removed entirely allowing free movement of the bearing rails.

Further, it is advantageous to connect the connecting members to the bearing rails so that they may be adjusted along the length of the bearing rail.

It is further advantageous to provide the connecting member joining the two bearing rails with a table like portion extending under the roving over which the roving normally passes. Above the table, a rotatably shaped arm is provided which arm is movable on activation of the blocking mechanism to simultaneously hold the tufted front end of the roving against the table. The positioning of the table in front of the draw belt assembly insures the introduction of the roving automatically once the machine is restarted.

Full details, of the present invention are set forth in the following description and are illustrated in accompanying drawings.

DESCRIPTION OF THE INVENTION

Figure 1:
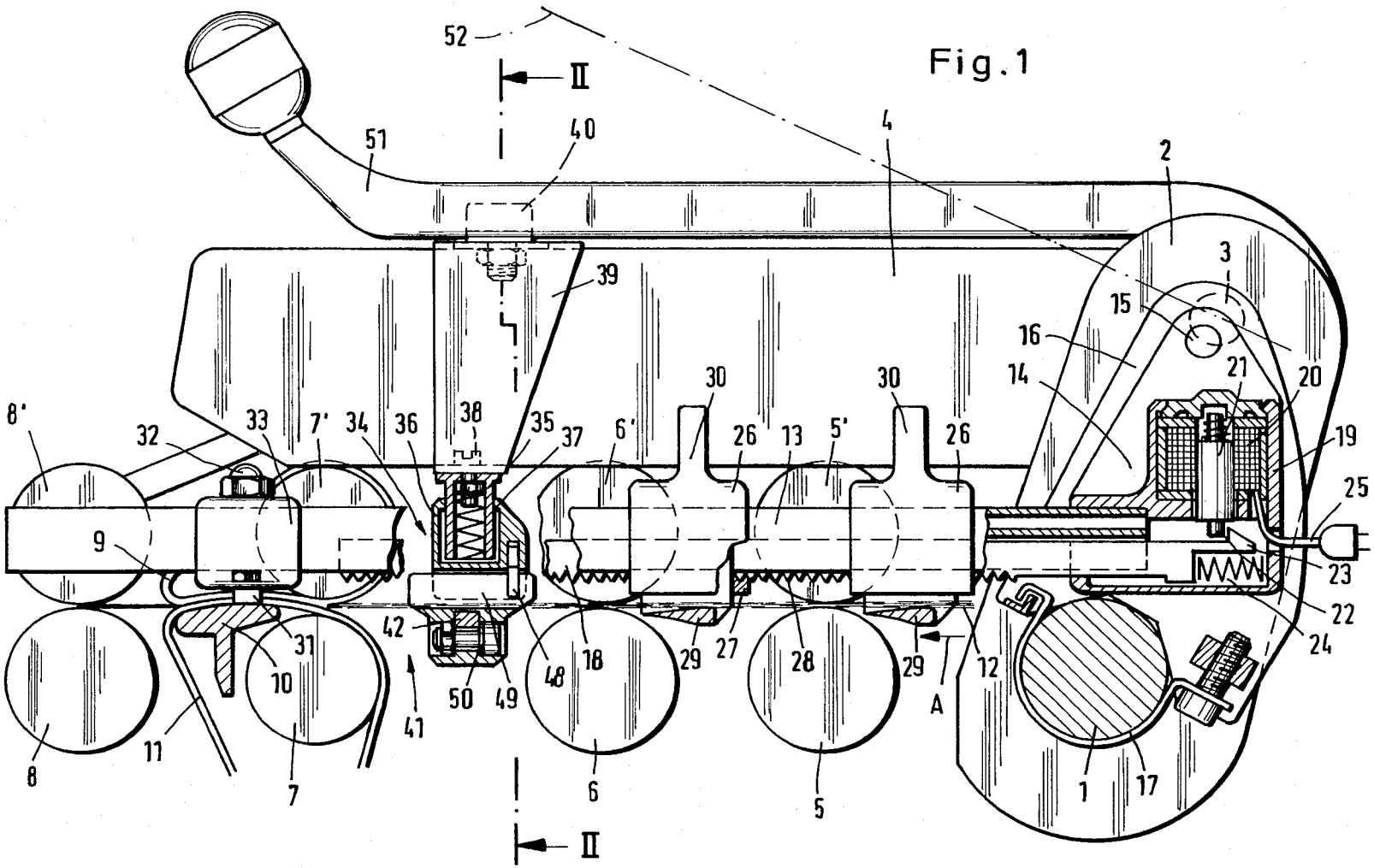
FIG. 1 is a lateral side view of a drawing frame with a partial open roving blocking mechanism as well as a roving holder, shown in the position they take during operation of the drawing frame.

The spinning machine, the basic structure of which is known and therefore not shown in detail in the drawings, is provided with a plurality of drawing frames. In accordance with the present invention, the frame, as seen in FIG. 1 comprises a supporting rod 1 fixedly mounted to the housing frame of the spinning machine. A support shoulder 2 is fixedly mounted on the rod and a load arm 4 is pivoted about a bearing 3 journalled in the support shoulder 2.

The load arm 4, shown in its operating position in FIG. 1, supports a series of twin upper draw rollers 5', 6', 7', and 8', which are freely rotatable about their central axes. Mounted also on the machine frame below the load arm are a set of power driven rollers 5, 6, 7, and 8 matching the twin upper rollers 5' through 8' respectively. An upper belt 9 is entrained over each of the upper rollers 7' and a cage (not shown), while a corresponding lower belt 11 runs over each of the lower rollers 7 and a bridge 10 in the corresponding position to the cage. A pair of rovings 12 runs through each set of the paired rollers of this frame in the direction of the arrow A.

Figure 2:
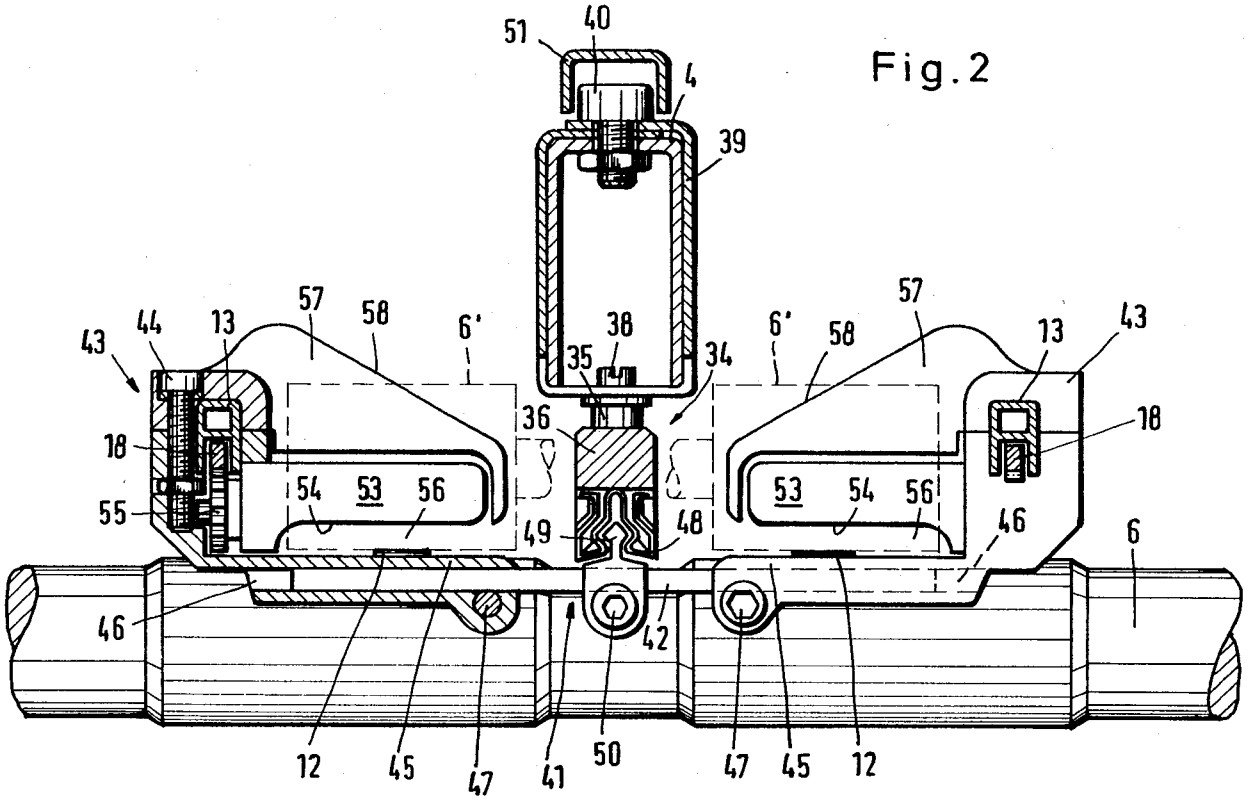
FIG. 2 is a cross sectional view of the drawing frame taken along lines II—II of FIG. 1.

At least one roving blocking mechanism is mounted on each side of the load arm 4 along the path of the respective rovings 12 and extending transversely thereto. Each roving blocking mechanism is mounted on a respective bearing rail. Each bearing rail is arranged to extend from a vertical support plate 14 parallel to the load arm 4. The vertical support plate 14 depends pivotally about a bearing 15 extending from a holding plate 16 which is fixedly fastened by means of clamp 11 to the supporting rods 1 in such a way that the bearing 15 is positioned coaxially with each other. Each bearing rail 13 has as shown in FIG. 2, a U-shaped cross section in which is accommodated a lengthwise movable slide 18 projecting with its rear end into a housing 19 mounted on the support plate 14. The housing 19 contains a solenoid 20, the movable core 21 of which, with its attached bolt 22 is cooperatively associated with a locking catch 23 formed on the rearward most end of the slide 18. The slide 18 is biased by the force of a compression spring 24 which bears against the end of the slide against the housing 19. The solenoid 20 is connected by means of a cable 25 with a thread regulator and sensing means assigned to the thread emerging from the draw frame. The thread regulator, emitting a pulse, if the thread is ruptured, which excites the solenoid 20. Upon excitation of the solenoid, core 21 is drawn inwardly and the bolt 22 releases the locking catch 23 and the slide 18 is caused to move by the spring 24 to the left as seen in FIG. 1.

Two identical roving clamping members 26 are shown mounted on each bearing rail 13 so as to be adjustable lengthwise there along. A coupling tooth 27 is secured to the slide 18 and is adapted to engage a rack 28 formed on the lower edge of the rail 13, to thereby provide a stop means which fix the clamping member adjustably to the rail 13. In this manner, each clamping member 26 is conjointly movable with the slide 18 when solenoid actuated, while at the same time being adjustable relative to the rail itself.

A locking wedge 29 is formed on the clamping member 26 so that it extends beneath the roving 12. The wedges 29 are movable into a clamping position between the paired rollers 5, 5' and 6, 6' respectively upon the forward movement of the rail 13 so that the roving 12 is lifted from the lower roller 5 and 6 respectively and clamped against the upper roller 5' and 6' respectively which is then held stationary by the wedge 29.

A fibre tuft is produced in the area between the paired rollers 6, 6' and the paired rollers 7, 7' during the above operation; rollers 7, 7' continuing to run since they are unaffected by the blocking mechanism. As a result, the tuft becomes the terminal end of the roving and further loss of fibres and lapping on the draw frame rollers 7, 7' and 8, 8' is prevented. Feeding of the roving itself from the bulk source can also be interrupted by means well known to those skilled in the art. The clamping mechanism 29 and the clamping of the roving may be easily shifted and removed by the manipulation of a handle 30 extending from the top of each clamping member 26 and the manual pushing of the clamping member rearwardly relative to the rail 13.

Further or additional details of the construction of the draw frame may be obtained from the aforementioned applications, which are incorporated herein as if more fully set forth.

As indicated earlier, there are two bearing rails, mounted one on each side of the support arms 4. Each of the bearing rails are held in a simple swivel bearing 15 and are otherwise freely movable about the bearing 15. In order to keep the bearing rails 13 in their operating positions, i.e. horizontal, a lower fixed stop mechanism is provided and as upper spring loaded biasing mechanism is provided forcing the bearing rails resilently against the fixed stop.

The lower stop mechanism comprises a stop member 31 connected to each of the bearing rail 13 which is adapted to engage the respective bridge 10 which as earlier described is fixedly mounted on the machine. The stop member 31 is the free end of an adjustable screw 32 inserted and lockable in a carrier 33, which is arranged to be slidable along the length of the bearing rail 13 and locked in place by the screw 32 at the desired position relative to the bridge 10.

The resilent biasing mechanism generally denoted by the reference numeral 34 comprises a pair of telescoping tubes 35 and 36 which are provided with correspondingly inward and outward circumferential flanges which limit their outward extension. A pressure spring 37 is arranged within the inner telescoping tube 35 and acts upon the inner frontal wall of the outer telescoping tube 36 endeavoring to push both of the tubes into their most extended position. The inner telescoping tube 35 is fastened to a hollow rectangular carrier bracket 39 by means of a screw 38. The carrier bracket 39 which has a cross section conforming to the outer cross section of the support arm 4 is mounted over the latter so as to be lengthwise adjustable thereon. The bracket 39 is locked by means of a screw 40 to the arm 4 at a predetermined point. A snap coupling generally denoted by the numeral is provided to disengageably connect the plunger 34 to the rails 13. The outer telescoping tube 36 carries a pair of laterally distendable arms forming a female portion of the snap coupling while the mail coupling portion 49 is arranged on a rod member 42 which connects the two bearing rails 13.

The connecting member 42 is mounted at each end on a mount 43 adjustably positioned lengthwise on each of the bearing rails 13. The mount 43 comprises an upper and lower portion held together by a screw 44 which permits the entire mount to be moved lengthwise on the bearing rail and fixed at a desired point along the rail. The lower portion of the mount 43 is provided with a table 45 extending laterally inward toward the load arm 4 beneath the roving 12, and transverse to the direction of travel A.

The table 45 forms a support for the roving 12 between the rollers 6 and 7 and is provided with a hole 46 extending transversely and parallel to the table on its lower surface, which hole is adapted to receive the rod connecting member 42. A clamping screw 47, extending at right angles to the hole 46 engages the connecting member 42 inserted therein and clamps the latter fast in the hole 46. This arrangement fixedly connects the two bearings rails 13 with each other along its length at a point which may be adjusted to fit the respective machine structure. Preferably, the connecting rod 42 is square in-cross section although other forms can be used.

Mounted midway along the connecting member of 42 is the male snap-coupling member 49. The member 49 extends elongately parallel to the length of the draw frame and has a diamond shape or pointed cross section which is adapted to engage and couple with the inner contours of the female coupling arms 48. The male snap coupling member 49 is fastened by a screw clamp 50 adjustably on the connecting member 42 so that it registers cleanly and smoothly with the female members 48. As can be seen, the male connecting member is formed in the shape of longitudinal bridge running at right angles to the swivel axes 3 and 15 of the support arm 4 and the bearing rails 13 respectively. The female spring coupling members 48 overlaps the longitudinal bridge shape and abutts with its free ends on the longitudinal edges of the male member, to thereby provide a stop between the two, on the downward movement of the support arm.

If the support arm 4 is swiveled upwardly in a partial or full non operating position indicated by the dot-dash line 52, of FIG. 1 i.e. by manipulation of a control lever 51 the bearing rails 13 will conjointly partake in the swiveling motion because of the snap coupling formed by members 48 and 49; the bearing rails 13 pivoting about their bearing axes 15. On the other hand, the load arm 4 can be raised as indicated, without simultaneously raising the bearing rails 13 by simply manually holding back the bearing rails 13.

Because the roving blocking mechanism is earmarked for interaction with support and load arms of variable design and size, the swivel bearings 15 for the bearing rails 13 are positioned coaxially with respect to each other but not generally coaxial with the swivel bearing 3 of the support arm 4. However, the design of this snap coupling 48, 49 is such that the relative shifts occurring as a result of the variable swivel paths can take place without disengaging the snap coupling 48, 49 through the respective sliding movements of the female spring arms 48 with respect to the male snap coupling member 49.

The snap coupling as a whole is, as illustrated, arranged expediently in the space between the belt unit 10 of the draw frame and the preceding pair of rollers 6 since it is in this space where an exposed fibre tuft is created during the blockage of the roving. The tables 45, on which the connecting member 42 is fixed, extend beneath the general run of each of the respective rovings and serve simultaneously as a support for the fibre tuft, preventing the dropping of the fibre tuft between the rollers 6 and 7. Thus, the fibre tuft end of the roving is held upon the table in the plane of the run of the roving so that upon restart of the draw frame, the roving passes smoothly and easily into and between the belts 10 and 11. Thus automatic restarting of the roving can be assured.

Some spinning machines are equipped with a cleaning blower or vacuum device which is directed toward the area of the drawing frame prior to the belts illustrated as 10 and 11. In order to prevent any air current produced by these devices from blowing the fibre tuft from the table, a holding member 53 is provided which extends over the table 45 and is rotatable about its central axis. The holding member 53 is a cantilevered cylindrical arm formed with a land or flattening 54 normally positioned above the table 45 so as to provide a slot 56 between the roving and the holding member. The remainder of the holding member is circular and is provided at its outer end with circular gear 55 which engages with the teeth 28 of the slide 18. The holding member 53 is arranged so that the slot 56 is maintained between the table 45 and the flattening land 54 is maintained during operation and movement of the roving so that unhindered movement of the roving is permitted. When, however, the slide 18 is shifted forwardly so that it effects the blocking of the roving, it causes the holding member 53 to make half revolution as a result which the arcuate circumferential surface faces the roving 12 such that it holds the fibre tuft, thus created, fast between itself and the table 45.

Since the holding member 53 is journalled within the bracket 43 to which the connecting member 42 and the table 45 is connected it is necessary during the insertion of the roving 12 into the draw frame to introduce the roving into the slot 56 existing between the table 45 and the land 54. The roving is inserted by first swiveling the support arm 4 into its upward position while maintaining the bearing rails 13 in their horizontal position as illustrated, this allows manual access to the slot 56. To further facilitate the entry of the roving into the slot 56 a plate like member 57 is provided overlapping the holding member 53. The plate 57 is mounted on the mount 43 and has a guide slope 58 descending from outward inward toward the freely projecting end of the holding member 53. This incline allows the roving to be easily placed into the slot 56. The roving 12 can be also automatically positioned, when the load arm 4 is in lifted position by placing the roving straight on the rollers 5 through 8 while lying on the inclined surface 58. The roving will automatically slide down into the slot 56 upon initiation of the running of the draw frame since the tension placed on the roving will shorten the roving and cause it to descend the incline automatically.

The connecting member 32 joining the rails 13 assures that the roving 12 enters the slot 56 since as the roving slides off the incline 58, the connecting member 42 prevents it from falling below the rollers and/or the bridge formed by the belts 10 and 11.

Since various modifications and embodiments have been disclosed herein and other will be obvious to those skilled in the art, it is intended that the present disclosure be taken as a illustrative only of the invention and not as limiting thereof.

What is claimed is:

1. A drawing frame for a thread spinning machine comprising at least a set of inlet rollers for receiving a roving from a source, a set of exit rollers spaced from the inlet rollers and between which said roving is drawn, each of said inlet and exit roller sets comprising a lower driven roller and a pair of axial spaced upper rollers permitting the drawing of two rovings side by side, said upper rollers being journalled in ranked pairs on a common supporting arm journalled at its upstream and extending operatively in a horizontal direction to cause said upper roller to engage with said lower rollers and being liftable therefrom to remove said upper rollers from engagement with the lower rollers, a bearing rail extending along each side of said supporting arms, said bearing rails being journalled at their downstream ends to be freely movable to a position parallel to the operative horizontal position of said supporting arm and to a position lifted upwards therefrom, and blocking means mounted on each rail for holding said roving to said upper roller responsive to the sensing of a breakage of the thread, and means for causing said supporting arm to freely weigh on said bearing rails, and means disengageably maintaining said supporting arm and bearing rails parallel in operative position, while permitting disengagement and independent lifting movement of said supporting arm and said bearing rails.

2. The draw frame according to claim 1 wherein said bearing rails are joined by a connecting member extending beneath said supporting arm, and includes resilent means interposed between said supporting arm and said connecting member.

3. The draw frame according to claim 2, wherein said resilent means comprises a plunger formed of a pair of telescoping tubes having a compression spring arranged within said tubes to bias said tubes into a normally outward extension, one of said tubes being secured to one of said supporting arm and connecting member, said tubes having means for limiting their outward extension.

4. The draw frame according to claim 3 including disengageable snap coupling having one portion secured to said plunger and a second portion to the other one of said support arm and said bearing rail connecting member.

5. The draw frame according to claim 2 wherein said connecting member comprises an elongated rod, said rod being adjustably secured at each end to a mount movably secured on each of said bearing rails for adjustment therealong.

6. The draw frame according to claim 5, wherein each of said mounts includes a table extending beneath said roving.

7. The draw frame according to claim 6, including an arm rotatably mounted in opposition to said tubes above said roving, said arm being selectively movable into a first position to provide a space with respect to said table for movement of said roving and into a second position in which said arm grasps the roving against said table.

* * * * *